United States Patent [19]

Hicks

[11] 3,984,896

[45] Oct. 12, 1976

[54] SAFETY DEVICE FOR LINT CLEANERS

[76] Inventor: George O. Hicks, 1660 S. McCall, Selma, Calif. 93662

[22] Filed: Aug. 14, 1975

[21] Appl. No.: 604,610

[52] U.S. Cl. ..... 19/.23; 19/97.5; 19/200; 192/125 A; 198/855

[51] Int. Cl.[2] ..... D01G 31/00; B65G 43/08

[58] Field of Search ..... 19/.2, .23, .25, 97.5, 19/64.5, 55 A, 200; 192/125 A, 125 B, 125 C, 129 A, 133, 135

[56] References Cited

UNITED STATES PATENTS

| | | | |
|---|---|---|---|
| 488,446 | 12/1892 | Murray | 19/64.5 |
| 2,057,641 | 10/1936 | Curley et al. | 19/97.5 X |
| 2,224,272 | 12/1940 | Myers et al. | 19/55 A |
| 2,636,223 | 4/1953 | De Santis et al. | 19/.21 |

FOREIGN PATENTS OR APPLICATIONS

| | | | |
|---|---|---|---|
| 333,038 | 9/1903 | France | 19/.2 |
| 587,124 | 1/1959 | Italy | 19/.23 |
| 12,019 | 1899 | United Kingdom | 19/.23 |

*Primary Examiner*—Dorsey Newton
*Attorney, Agent, or Firm*—Huebner & Worrel

[57] ABSTRACT

A safety device for lint cleaners and the like through which lint is traveled in a predetermined path in a bat which varies in thickness between acceptable limits and occasionally exceeds such limits having a probe mounted adjacent to the path engageable with the lint and movable in response to variations in thickness thereof, and a switch in controlling relation to the lint cleaner responsive to movement of the bat engageable means adapted to render the cleaner inoperable whenever the thickness of the bat exceeds a predetermined maximum.

8 Claims, 7 Drawing Figures

SAFETY DEVICE FOR LINT CLEANERS

BACKGROUND OF THE INVENTION

The present invention relates to a safety device and more particularly to such a device for lint cleaners and the like through which lint is traveled in a predetermined path in a bat which varies in thickness between acceptable limits and occasionally exceeds such limits adapted to render the lint cleaner inoperable whenever the bat exceeds a predetermined thickness.

In the cotton ginning art, lint cleaners are notorious for maiming their operators. The lint to be cleaned is traveled in an air stream to a condenser on which the lint accumulates and from which it is removed by doffers in the form of a bat which is directed between cooperative rollers for further processing. The bat varies in thickness to a considerable extent and when it becomes too thick, it jambs up the feed rollers and/or the doffers. When this occurs, an attendant opens an access door and endeavors to remove the excess lint and correct the cloggage. Many times this is done without turning off the cleaner. In many other instances, even if the cleaner is turned off, the momentum of its driving motor, drive linkage, and driven components maintains rotation for 5 minutes or more. Thus, because of impatience, forgetfulness or carelessness, attendants frequently take corrective measures while the feed rollers and doffers are still rotating. When this is done, the attendant frequently gets his arm caught between the feed rollers and in a matter of seconds, his arm is mangled and in many instances torn from his body. The injuries are almost identical and are so serious that only a very small percentage of those so injured ever regain the use of the arm involved. Prior to the present invention, the industry has endeavored to minimize such accidents by warning and education but human error continues to result in repetition of such injury.

SUMMARY OF THE INVENTION

The primary object of the present invention is to eliminate the accidents in lint cleaners and the like resulting from attendants having access to the operating mechanisms of such cleaners while they still are in operation.

Another object is to detect the objectionable increase in bat thickness of lint traveled through a lint cleaner or the like and immediately to interrupt operation thereof upon such detection.

Another object is immediately to interrupt operation of lint cleaners and the like when access is had to their internal operating mechanisms.

Another object is automatically to provide for a warning signal whenever the bat thickness of the lint traveled through a lint cleaner exceeds a predetermined level and/or whenever access is had to the internal working mechanisms of such cleaners.

Further objects and advantages are to provide improved elements and arrangements thereof in a safety device for lint cleaners and the like which are dependable, economical, durable and fully effective in performing their intended functions.

DESCRIPTION OF THE PREFERRED EMBODIMENT

Figure 1:
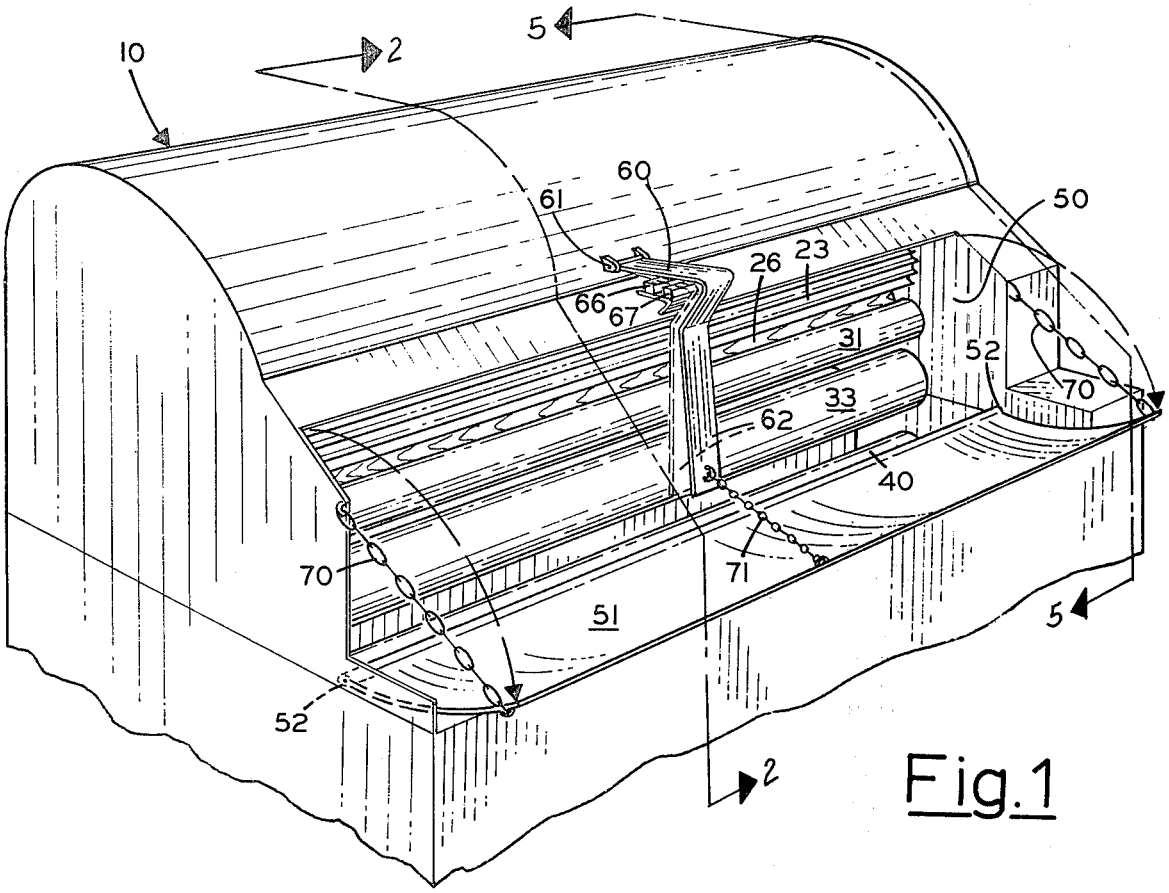
FIG. 1 is a fragmentary perspective of a conventional lint cleaner equipped with the safety device of the present invention.

A conventional lint cleaner is shown generally at 10 and may be of any suitable form. The cleaner provides a housing 11 having an intake 12 connected to a supply conduit 13.

The intake 12 leads to a condenser screen drum 20 mounted on a substantially horizontal shaft 21 in the housing. The housing defines a throat 22 adjacent to the drum 20. A doffer 23 having peripherally extended flights 24 is mounted in the throat on a doffer shaft 25. A wooden doffer 26 having a smooth periphery is mounted in the throat on a doffer shaft 27. By means which will subsequently be described, the drum 20 is rotated in a counterclockwise direction, as viewed in FIG. 2. The flighted doffer 23 is rotated in a counterclockwise direction and the doffer 26 in a clockwise direction in sufficient proximity to the condenser drum that they doff lint therefrom.

The housing 11 provides a downwardly directed conduit 30 having an upper end connected to the throat 22. Adjacent to the doffer 26, and therebelow is a first feed roller 31 mounted for rotation on a shaft 32 and a second feed roller 33 mounted for rotation on a shaft 34. The shafts 32 and 34 are disposed in a substantially vertical plane. Downwardly from the second feed roller 33 are two pairs of horizontally adjacent cooperative feed rollers 40 and 41 as well as a second pair 42 and 43. The feed rollers 40 and 41 are mounted on shafts 44 and 45 respectively and the feed rollers 42 and 43 mounted on the shafts 46 and 47.

A side wall of the conduit 30 has an elongated opening 50 releasably closable by a door 51 pivotally mounted at 52 and upwardly extended therefrom.

The structure described to this point is essentially conventional and constitutes operational environment for the safety device of the present invention. During use, lint 55, such as cotton which has already been seeded, is blown up the supply conduit 13 through the intake and against the rotating condenser drum 20. The doffers 23 and 26 remove the lint from the drum and direct it into a bat 56 which is drawn downwardly by the first and second feed rollers 31 and 33 and extends between the horizontally spaced cooperative feed rollers 40 and 41 as well as 42 and 43. The interior of the conduit 30 is accessible through the opening 50 and the accidents to which reference has been made usually occur by the attendant getting his fingers, hands, attire, or arms drawn between the pairs of cooperative feed rollers.

Figure 3:
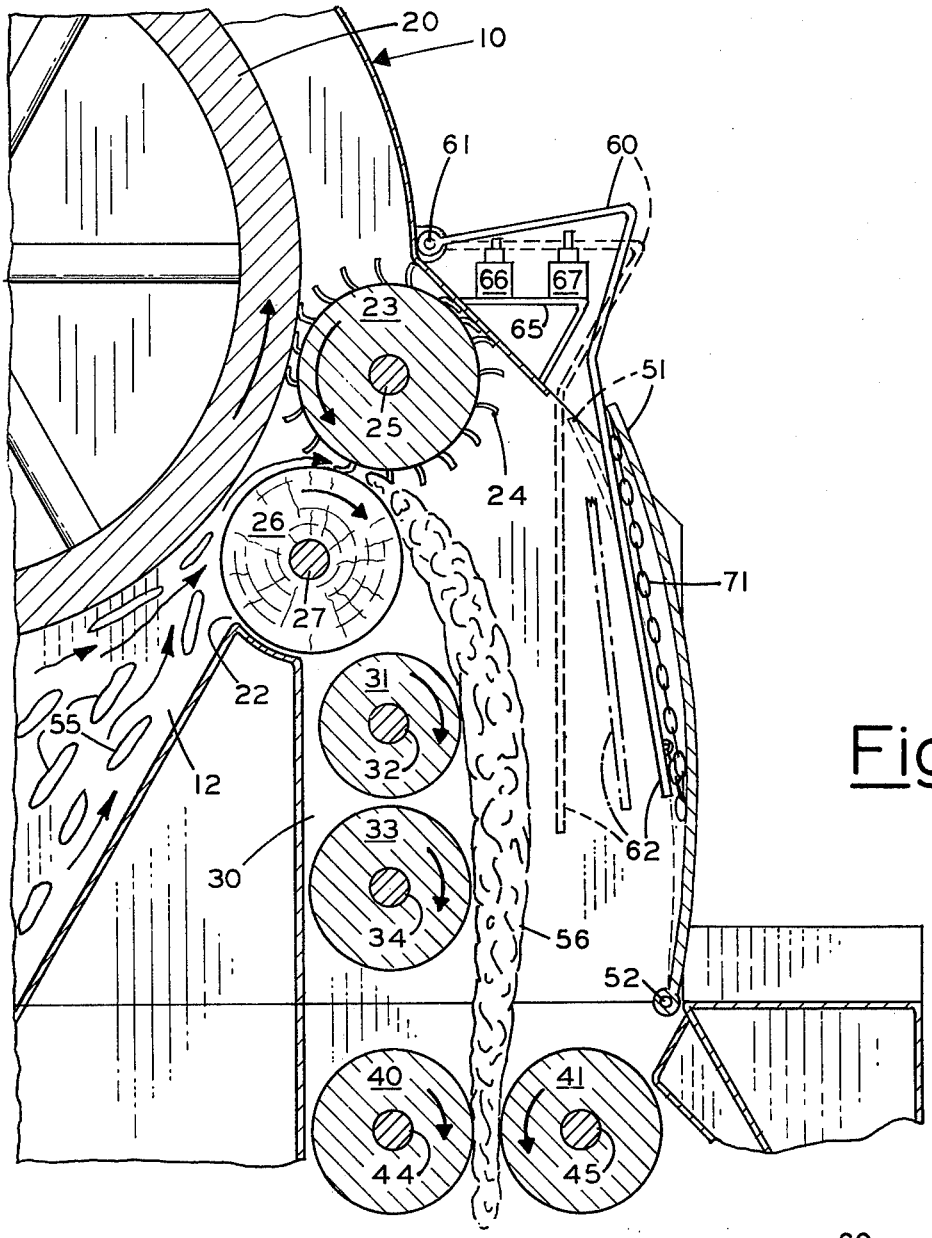
FIG. 3 is a somewhat enlarged fragmentary portion of FIG. 2.

As best shown in FIGS. 1 and 3, a probe 60 is pivotally mounted on the housing 11 at 61 upwardly adjacent to the opening 50. The probe extends substantially horizontally outwardly from its pivot 61, then downwardly and inwardly of the upper edge of the opening 50 and thence downwardly within the housing to provide a detector portion 62. The detector portion has three positions illustrated in FIG. 3. Its normal rest position is shown in dashed line. In dot-dash line, its partially displaced position is shown and in full line its fully displaced position.

A bracket 65 is mounted on the housing 11 below the substantially horizontal portion of the probe 60 and supports a pair of microswitches 66 and 67. The microswitch 66 is normally open but closed when the probe is pivoted downwardly and rests thereon. The microswitch 67 is normally closed but opened when the probe is pivoted downwardly and rests thereon. The microswitches are so positioned that when they support the probe, the detector portion 62 thereof is disposed within the housing closely adjacent to the bat 56, when it is of an acceptable thickness. This position is shown in dashed line in FIG. 3. When the bat becomes objectionably thick and threatens to jamb the feed rollers, the lint of the bat forces the probe outwardly. As the probe pivots to the dot-dash position, the microswitch 67 is first disengaged and permitted to close. As will subsequently be described, this actuates an alarm. If the pivotal movement of the probe continues outwardly to the full line position under the urging of a bat of increased thickness, the microswitch 66 is next released and opens to interrupt the operation of the drum 20, doffers 23 and 26, and feed rollers 31, 33 and 40 through 43.

Figure 2:
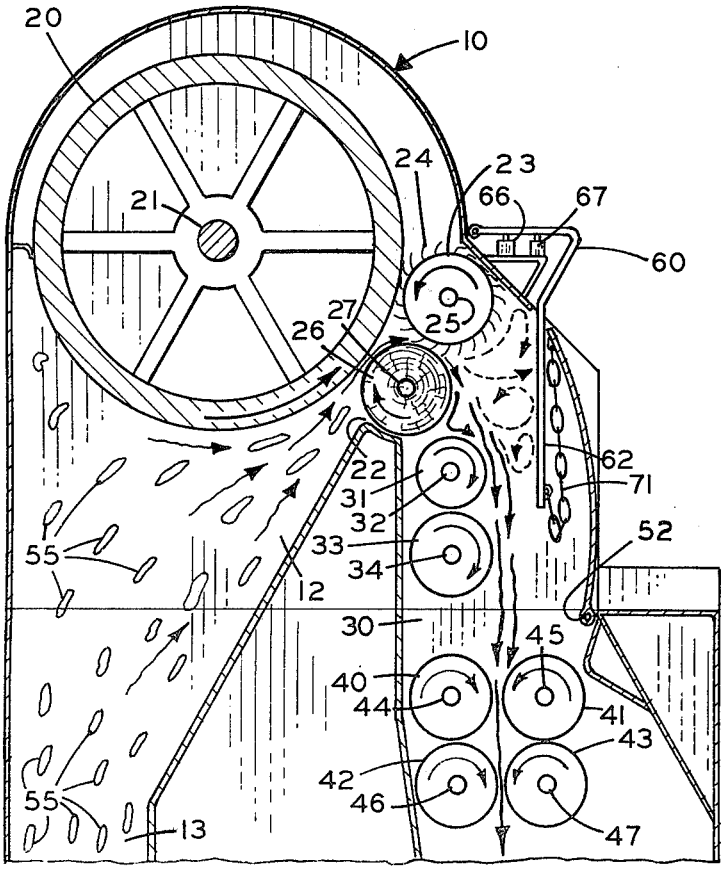
FIG. 2 is a vertical section taken on line 2—2 in FIG. 1.

As previously noted, the door 51 is pivotally mounted at 52 for movement between a position closing the opening 50, as shown in FIGS. 2 and 3 and an open position shown in FIG. 1. A pair of chains 70 interconnect the door and the housing so as to limit the extent of opening movement of the door to that sufficient for access to the interior of the conduit 30 of the housing. A chain 71 or other flexible tension member interconnects the detector portion 62 of the probe 60 and the door 50 and is of such length that when the door is from half to three-quarters open, the chain tightens and pulls the probe 60 into its outer position first withdrawing from the microswitch 67, permitting it to close, and then withdrawing from the microswitch 66, permitting it to open.

Figure 5:
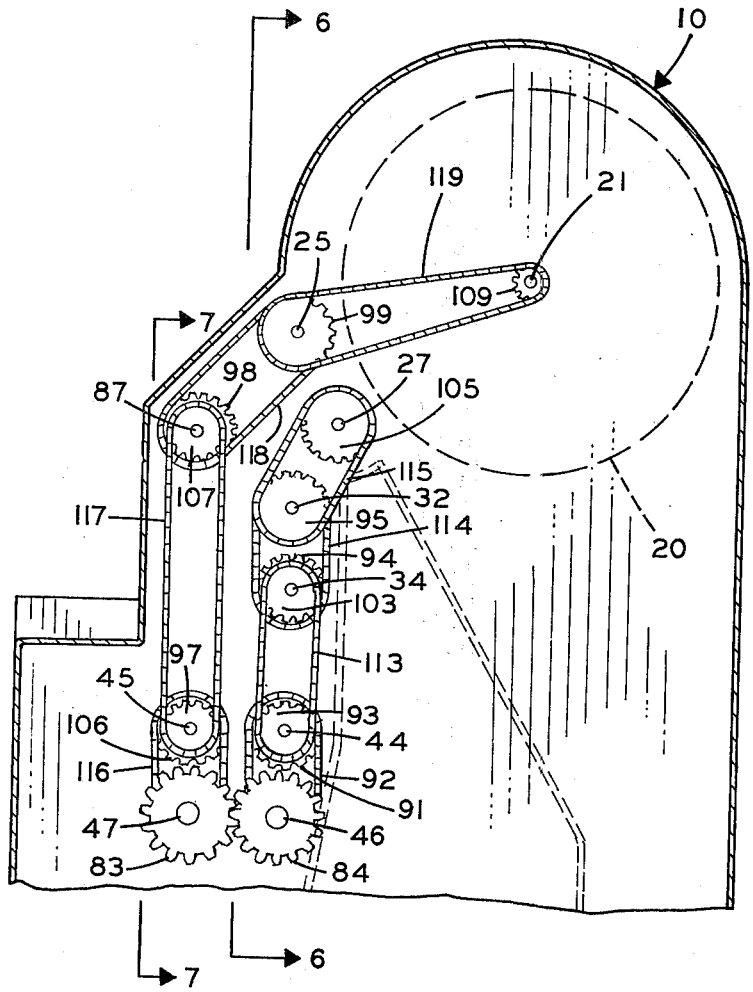
FIG. 5 is a fragmentary section taken on line 5—5 of FIG. 1 showing a modified drive system as provided by the present invention.

In conventional lint cleaners, a single large motor is employed to drive the entire mechanism including with the drum 20, doffers 23 and 26, and feed rollers 31, 33 and 40 through 43 much additional structure normally including a high speed, fine tooth saw, a brush operably associated with the saw and other structure, not shown. Such motors, their drive systems, and the elements driven thereby possess so much inertia that after the motor is de-energized it and the mechanism will continue to rotate for several minutes. This is carefully avoided in the device of the present invention. As best shown in FIG. 5, a motor 80 having a gear head 81 has driving connection to the shaft 47 through a drive linkage 82. A drive gear 83 is mounted on the shaft 47 in mesh with a drive gear 84 mounted on the shaft 46. The gears 83 and 84 are of the same diameter so that when the motor 80 rotates the shaft 47, the shaft 46 is rotated at the same speed but in the opposite direction.

Figure 6:
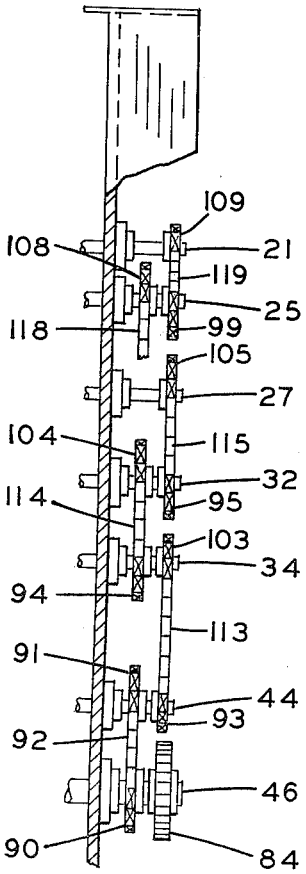
FIG. 6 is a section taken on line 6—6 of FIG. 5.
Figure 7:
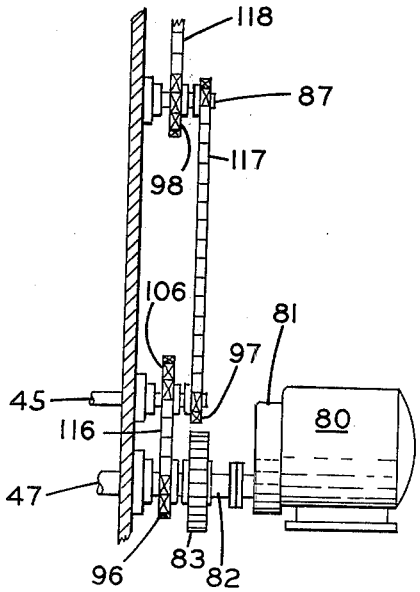
FIG. 7 is a fragmentary section taken on line 7—7 of FIG. 5.

For purposes soon to be described, an idler shaft 87 is provided in the housing 11 above the shafts 45 and 47 at approximately the elevation of the shaft 27. As best shown in FIGS. 5 and 6, a drive sprocket 90 is mounted on the shaft 46 and a driven sprocket 91 on the shaft 44. A chain 92 circumscribes the sprockets 90 and 91 and provides driven interconnection therebetween. Similarly, drive sprockets 93, 94, 95, 96, 97, 98 and 99 are provided on the shafts 44, 34, 32, 47, 45, 87 and 25 respectively. Companion driven sprockets 103 through 109 are provided on shafts 34, 32, 27, 45, 87, 25 and 21 respectively. Chains 113 through 119 individually circumscribe their respective drive sprockets 93 through 99 and their companion driven sprockets 103 through 109 and provide driving interconnection therebetween and thus rotate the feed rollers 32, 34 and 40 through 43; the doffers 23 and 26 and the drum 20. The drive sprocket 98 and the driven sprocket 107 on the idler shaft 87 are interconnected to rotate together. The drive linkage described is in most respects conventional except that it is entirely divorced from the high inertial associated structure with which the feed rollers, doffers and drum normally share a common drive.

The gear head 81 on the motor 80 and the sprockets 93 through 99 and driven sprockets 103 through 109 are relatively sized so that the feed rollers 31, 32 and 40 through 43 are rotated at from approximately 140 r.p.m. to 150 r.p.m. while the drum 20 is rotated at approximately 300 r.p.m.

Figure 4:
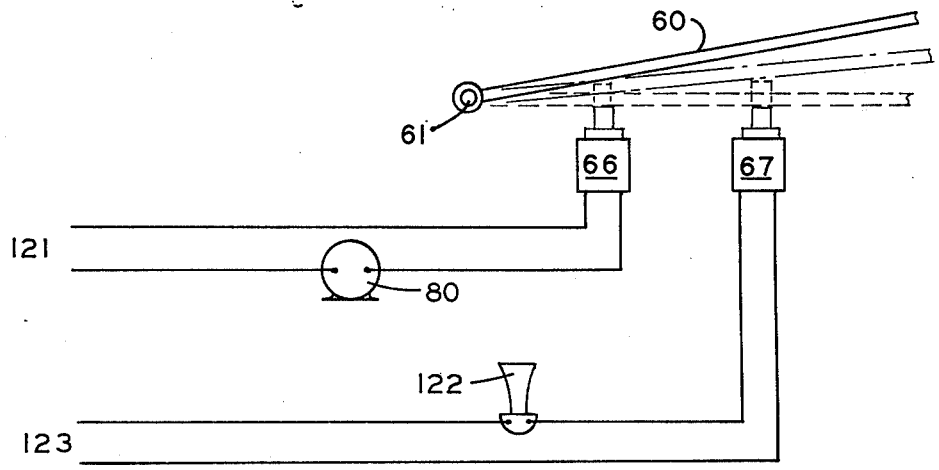
FIG. 4 is a schematic wiring diagram for the safety device of the present invention.

As shown in FIG. 4, the normally open switch 66 is connected electrically in series with the motor 80 and to any suitable source of electrical energy 121. The normally closed switch 67 is connected electrically in series with a warning signal 122, such as a horn and to a suitable source of electrical energy 123.

OPERATION

The operation of the described embodiment of the present invention is believed to be clearly apparent and is briefly summarized at this point. The door 51 is closed into the opening 50 and the detector portion 62 of the probe 60 assumes the position shown in dashed lines in FIG. 3. The motor 80 is actuated and serves to rotate the feed rollers 43 and 41, the doffer 23, and the drum 20 in a counterclockwise direction, as viewed in FIGS. 2 and 3, and the feed rollers 42, 40, 33 and 31 and the doffer 26 in the clockwise direction. The associated mechanism, not shown, is actuated so as to deliver lint 55 in air stream from the supply conduit 13 through the intake 12 to impinge on the drum 20 in the well known manner. As the drum rotates, the doffers 23 and 26 remove the lint from the drum in a bat 56 which passes between them and is guided and drawn downwardly by the feed rollers 31 and 33. The bat is directed downwardly between the cooperative feed rollers 40 and 41 and then between the feed rollers 42 and 43. The bat, of course, continues to a fine tooth saw working in conjunction with slat bars and a brush and other associated structure well known in lint cleaners but not shown in the drawings.

As long as the bat 56 remains of substantially uniform thickness and out of engagement with the detector portion 62 of the probe 60, the operation continues unabated. However, if the bat becomes increasingly thick or entangled in the throat 22 or conduit 30, it presses against the detector portion 62 and urges it outwardly to the position shown in dot-dash line in FIG. 3. This permits the switch 67 to close actuating the warning signal 122. If the bat or entanglement increases in thickness, it forces the detector portion 62 farther outwardly thus enabling the switch 66 to open interrupting operation of the motor 80.

Similarly, if for any reason an attendant opens the door 51, the detector portion is first moved into the dot-dash position shown in FIG. 3 permitting the switch 67 to close so as to actuate the alarm 122. If the door is opened further, it draws the probe outwardly by means of the chain 71 to the full line position shown in FIG. 3 releasing the switch 66 to open and interrupt the motor 80.

Because of the gear head 81 and the relatively minor inertia of the feed rollers 31, 33 and 40 through 43, drum 20 and doffers 23 and 26, the rotation thereof promptly terminates when the switch 66 is opened. Instead of coasting for several minutes, the feed rollers, doffers, and drums cease their rotation in a matter of a few seconds. Once the clogged condition is corrected, or the bat manually thinned, the door 51 is closed permitting the probe to return to the dashed line position shown in FIG. 3 so as to close the switch 66 starting the motor 80 and to open the switch 67 deactuating the warning signal 122.

The safety device of the present invention has made it virtually impossible for an attendant to be injured by the doffers 23 or 26 or the feed rollers 31, 33 or 40 through 43. In most instances, the motor 80 stops immediately after the sounding of the warning device 122. Thus by the time an attendant can open the door 51 to gain access to the interior of the housing 11, the operating elements of the lint cleaner are at a standstill and of virtually no hazard.

As described, if the thickening of the bat 56 or the otherwise entanglement of the lint 55 is sufficient to close the switch 67 but insufficient to open the switch 66, the warning signal 122 is nevertheless actuated. An attendant seeking to correct the problem then opens the door 51 whereupon the chain 71 draws the probe 60 into its fully retracted position opening the switch 66 and stopping the motor 80 and all associated doffers, feed rollers and drum before the attendant can gain access to the interior of the housing.

The safety device of the present invention has virtually eliminated injury in lint cleaners equipped with the device. It is easy to install, economical, simple in structure, and thoroughly dependable. Most of the work involved in its installation has to do with the removal of the conventional drive system and the substitution of the gear head motor 80 for the drive of the enumerated drum, doffers and feed rollers so as to insure virtual immediate stopping whenever an emergency is detected by the probe 60 or the door 51 is opened.

Although the invention has been herein shown and described in what is conceived to be the most practical and preferred embodiment, it is recognized that departures may be made therefrom within the scope of the invention, which is not to be limited to the illustrative details disclosed.

Having thus described my invention, what I claim as new and desire to secure by letters patent is:

1. In an apparatus through which lint is traveled, feed rollers for conveying the lint along a predetermined path, drive means connected to the feed rollers, and a housing for the feed rollers having an access door movable between predetermined open and closed positions adjacent to the feed rollers; a safety device comprising A. a probe pivotally mounted adjacent to said predetermined path and the door having a rest position to which it gravitates adjacent to the path and a retracted position adjacent to the door to which it is thrust whenever the lint conveyed along the path exeeds a predetermined thickness;

B. an energizing circuit for the drive means having a switch closed by movement of the probe to rest position; and C. a linkage interconnecting the door and the probe which moves the probe to retracted position when the door is moved to open position.

2. The device of claim 1 in which the linkage is a flexible tension member interconnecting the probe and the door.

3. The device of claim 1 in which the drive means comprises an electric motor having a reduction gear head characterized by prompt stopping when the motor is de-energized.

4. In an apparatus through which lint is traveled having feed rollers for conveying lint along a predetermined path, and a housing for the feed rollers having an access door movable between predetermined open and closed positions; a safety device comprising A. a probe pivotally mounted between said predetermined path and the door having a rest position to which it gravitates adjacent to the path and a retracted position adjacent to the door, said probe being disposed in rest position so as to be thrust into retracted position whenever the lint conveyed along the path exceeds a predetermined thickness;

B. drive means connected to said feed rollers;

C. an energizing circuit for the drive means having a switch closed by movement of the probe to rest position and opened by movement of the probe to retracted position; and D. a linkage interconnecting the door and the probe which moves the probe to retracted position when the door is opened.

5. The device of claim 4 in which the drive means comprises an electric motor having a reduction gear head characterized by prompt stopping when the motor is de-energized.

6. In a lint cleaner having a condenser, means for delivering lint in an air stream to the condenser, means for doffing lint from the condenser, feed rollers for conveying lint from the condenser along a predetermined path, and a housing for the condenser, delivery means, doffing means and feed rollers having an access door movable between predetermined open and closed positions; a safety device comprising A. a probe pivotally mounted between said predetermined path and the door having a rest position to which it gravitates adjacent to the path and a retracted position adjacent to the door to which it is thrust whenever the lint conveyed along the path exceeds a predetermined thickness;

B. a unitary drive connected to said condenser, doffing means, and feed rollers;

C. an energizing circuit for the drive having a switch closed by movement of the probe to rest position and opened by movement of the probe to retracted position; and D. a linkage interconnecting the door and the probe which moves the probe to retracted position when the door is opened.

7. The device of claim 6 in which the probe also has an intermediate position between the rest and retracted positions to which it is thrust when lint conveyed along the path exceeds a predetermined intermediate thickness, the switch of the energizing circuit is closed when the probe is in the intermediate position, a second switch is provided in controlled relation to the probe which is open in rest position and closed in intermediate and retracted positions of the probe, and which device provides an electrically actuated signal connected to the second switch and actuated when the probe is in intermediate or retracted position.

8. In an apparatus having a housing through which lint is traveled in a predetermined path in the form of a bat which varies in thickness between acceptable limits and occasionally exceeds such limits, which housing has an access opening; means for feeding such a bat in the housing; drive means connected to the feeding means to actuate the same; means mounted adjacent to the path engageable with the bat and movable in response to variations in thickness thereof; means responsive to movement of the bat engageable means connected to the drive means adapted to render the drive means inoperable whenever the thickness of the bat exceeds a predetermined maximum; closure means mounted in the housing for movement to and from the access opening; and a linkage interconnecting the closure means and the bat engageable means moving the bat engageable means to render the drive means inoperable whenever the closure means is moved from the access opening.

* * * * *